US005226986A

United States Patent [19]

Hansen et al.

[11] Patent Number: 5,226,986

[45] Date of Patent: Jul. 13, 1993

[54] FORMULATION OF MULTI-COMPONENT EXPLOSIVES

[76] Inventors: Gary L. Hansen, 2869 Devereaux Way, Salt Lake City, Utah 84109; Richard E. Trapp, 1896 E. 6400 South, Salt Lake City, Utah 84121; Robert B. Clay, 728 W. 3800 South, Bountiful, Utah 84010

[21] Appl. No.: 790,342

[22] Filed: Nov. 12, 1991

[51] Int. Cl.[5] ..... C06B 21/00

[52] U.S. Cl. ..... 149/109.6; 86/20.1; 149/2; 149/6; 149/46; 149/61; 149/76; 149/77; 149/89; 149/108.2

[58] Field of Search ..... 149/2, 109.6, 46, 61, 149/76, 77, 89, 108.2, 6; 86/20.1

[56] References Cited

U.S. PATENT DOCUMENTS

| | | | |
|---|---|---|---|
| 289,761 | 12/1883 | Divine et al. | 149/109.6 |
| 2,892,377 | 6/1959 | Davidson | 86/1 |
| 3,344,743 | 10/1967 | Griffith | 102/23 |
| 3,718,512 | 2/1973 | Hurst | 149/2 |
| 3,744,427 | 7/1973 | Good et al. | 149/2 |
| 3,919,013 | 11/1975 | Fox et al. | 149/6 |
| 3,926,119 | 12/1975 | Hurst et al. | 102/24 |
| 3,926,698 | 12/1975 | Cook et al. | 149/44 |
| 3,985,593 | 10/1976 | Machacek | 149/89 |
| 4,142,928 | 3/1979 | Stewart | 149/109.6 |
| 4,207,125 | 6/1980 | Grant | 149/109.6 |
| 4,253,889 | 3/1981 | Maes | 149/76 |
| 4,388,254 | 6/1983 | Maes et al. | 86/20.1 |
| 4,764,319 | 8/1988 | Hightower et al. | 264/3.4 |
| 4,925,505 | 5/1990 | Baker et al. | 149/89 |
| 5,007,973 | 4/1991 | Trapp et al. | 149/109.6 |

OTHER PUBLICATIONS

Meyer, "Handbook of Explosives", Verlag Chemie, p. 246, (Sprengel Explosives) (1977) New York.

*Primary Examiner*—Edward A. Miller

*Attorney, Agent, or Firm*—Hubbard, Thurman, Tucker & Harris

[57] ABSTRACT

Process for the formulation of a multi-component explosive composition from non-detonable components comprising a defined body of unconsolidated particulate aluminum fuel granules and an oxidizing liquid. Specific particulate aluminum fuel has an average particle size within the range of about 1/64–¼ inch and is packed within a container or other confining structure to provide an average bulk density within the range of 0.2–1.0 gm/cc. The aluminum fuel particles are generally wadded-up aluminum foil granules. The oxidizing liquid added to the body of aluminum fuel fills the void space between granules of aluminum entrapping some voids within the granules to provide an average bulk density of the mixture of oxidizing liquid and particulate aluminum within the of 1.2–1.7 gm/cc, creating an explosive, formulation which is detonable in a diameter of 4 inches at 20° C. by a one pound pentolite booster and normally by a ½ pound pentolite booster. The oxidizing liquid can comprise an aqueous solution of an oxidizing agent selected from the group consisting of alkali metal and ammonium nitrates, alkali metal and ammonium perchlorates, alkaline earth metal nitrates, alkaline earth metal perchlorates and mixtures thereof and may also include a hygroscopic freezing point depressant which may act as a sensitizer. An alternative oxidizing liquid for use with the particulate aluminum fuel comprises a nitroparaffin selected from the group of nitromethane, nitroethane, nitropropane and mixtures thereof. A specific oxidizing liquid is a nitromethane and nitroethane mixture having a nitromethane to nitroethane ratio of 0.6–1.2, more particularly, about 1.0.

48 Claims, 2 Drawing Sheets

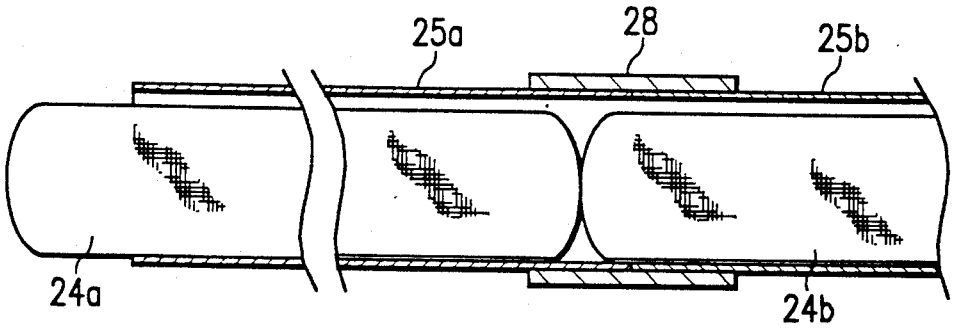
FIG. 3
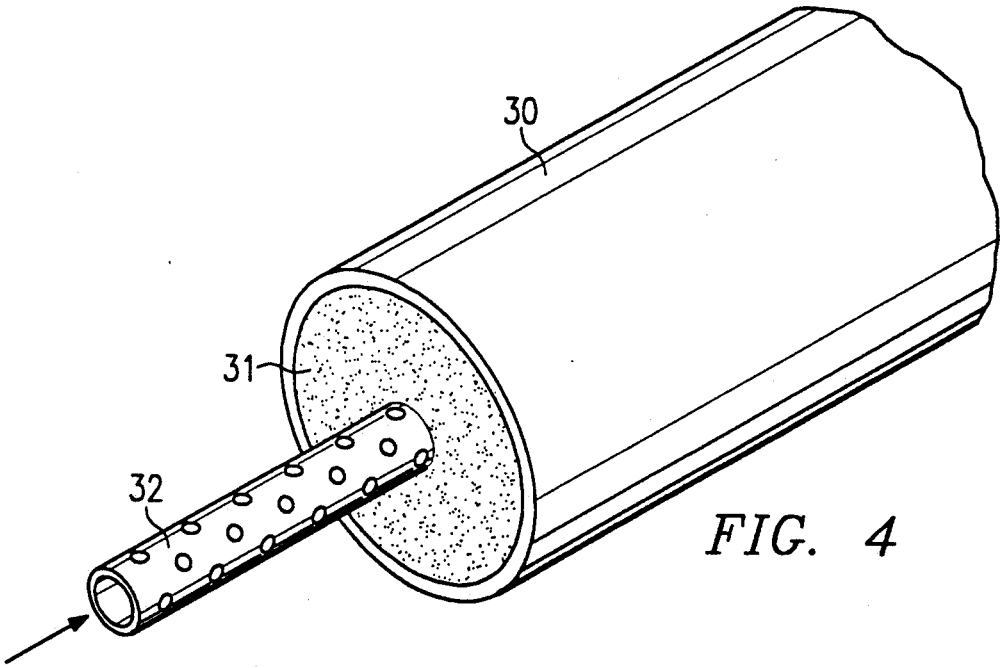
FIG. 4
FIG. 5
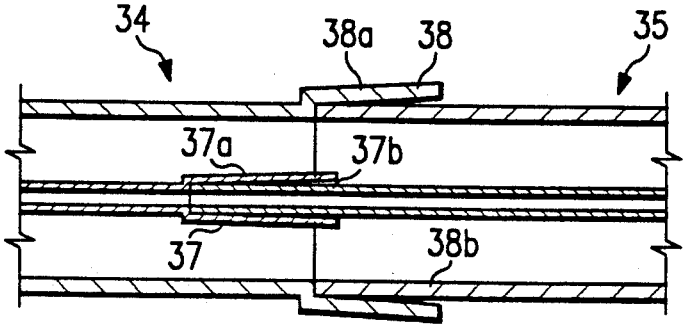

FORMULATION OF MULTI-COMPONENT EXPLOSIVES

FIELD OF THE INVENTION

This invention relates to multi-component explosive compositions formulated from separate solid non-explosive fuel and liquid oxidizing components and more particularly, to the formulation of such compositions from a defined body of particulate aluminum fuel granules and a liquid oxidizing agent.

BACKGROUND OF THE INVENTION

Explosive formulations based upon mixtures of particulate aluminum fuels in admixture with a liquid containing an oxidizing agent, which may be in the form of a solution or an emulsion, are well known in the art. For let, U.S. Pat. No. 5,007,973 to Trapp et al., discloses the formulation of an explosive composition from two liquid components which are, in themselves, not explosives. One component contains a finely divided metal fuel, preferably, aluminum, in a carrier liquid such as a polyhydric alcohol, e.g., ethylene glycol, and a pyrrolidone solvent. The carrier liquid contains a thickening agent which functions to impart thixotropic rheological properties to the suspension of particulate fuel. The oxidizing agent is an aqueous solution of an inorganic oxidizing salt such as an alkali metal or alkaline earth metal nitrate or perchlorate. The preferred oxidizing salt disclosed in the Trapp et al. patent is sodium perchlorate, either alone or in admixture with another oxidizing salt. The oxidizing liquid can contain microcells such as glass or plastic microbubbles or the like, which function to lower the density and sensitize the ultimate explosive formulation. In the Trapp et al. procedure, both the aluminum fuel particles and the microcells are of relatively small size. For example, the aluminum fuel has an average particle size within the range of 5–100 microns, thus providing a relatively high surface to volume ratio for the aluminum particles. While the explosive formulation in the Trapp et al. procedure provides a powerful high explosive after mixing, the individual components before mixing are relatively safe, pumpable liquids. Thus, the explosive formulations of the Trapp et al. patent are useful in military and non-military operations where it is desirable to blast ditches such as "tank traps" or fire break lines for the control of forest fires.

U.S. Pat. No. 3,344,743 to Griffith, discloses another procedure, for formulating blasting slurries which can be made at the blasting site from relatively safe component parts. Here, a metal fuel component such as aluminum is an optional additive. The aluminum can be added in the form of a powder or flake or as atomized in an amount within the range of about 0.5–15% of the total formulation. In the Griffith patent the oxidizing agent can take the form of alkali or alkaline earth metal chlorates, perchlorates or nitrates, preferably in admixture with ammonium nitrate.

Another procedure for the on-site formulation of slurry explosive compositions, which can include particulate aluminum as a fuel, is disclosed in U.S. Pat. No. 4,207,125 to Grant. Here, one component is a highly viscous or paste-like liquid phase which can contain one of the inorganic oxidizing salts such as an ammonium, alkali metal or an alkaline earth metal, nitrates, chlorates, perchlorates, peroxides or sulfates, which are known to function as oxidizers in explosive reactions. Freezing point depressants such as ethylene glycol, propylene glycol, glycerol and formamide, are used not only to depress the freezing point of the slurry formulation, but also to provide an optimum consistency. Thickening agents used in the oxidizing component include high molecular weight polysaccharides or polyacrylamides. At the detonation site, the liquid premixed phase is combined with an appropriate particulate material to produce a slurry explosive. The particulate material can include granulated or prilled ammonium nitrate and aluminum or magnesium metal with a particle size ranging from about 4 to 200 mesh. By way of example, 6 pounds of a thick sodium nitrate solution was stored for 35 days and then combined with 10 pounds of prilled ammonium nitrate, followed by agitation and then by the addition of 4 pounds of particulate aluminum having a particle size of +100 mesh and a thickness of 0.25 mills (Reynolds HPS-10), and the mixture then agitated to provide an explosive formulation having a density of 1.1 grams per cubic centimeter. The resulting slurry was detonated in a metal can with a pentolite charge.

An alternative approach to the formulation of binary explosives from non-detonable components is found in U.S. Pat. No. 2,892,377 to Davidson. Davidson discloses the mixing of the non-explosive components in a container. Thus, a cylindrical sheet metal canister is filled with ammonium nitrate particles. The canister is closed at its upper end with a wall structure having a central rubber pad. In order to form the blasting package, a syringe is employed to pierce the rubber pad and discharge an appropriate quantity of a non-explosive liquid organic fuel into the body of ammonium nitrate particles. The liquid fuel may contain a surfactant to reduce the surface tension between the ammonium nitrate and the liquid fuel. By way of example, from 92–95 parts of ammonium nitrate may be injected with 8 parts of orthonitrotoluene or 5 parts of hydrocarbon oil, respectively, to produce the blasting cartridge.

A similar approach, based upon the use of solid particulate oxidizing agents, is disclosed in U.S. Pat. No. 3,926,119 to Hurst et al. Here, a two-compartment container is employed which is divided by a porous partition into a lower primary charge chamber and an upper secondary, charge chamber. The charge chambers contain a particulate oxidizing component such as one or more alkali and alkaline earth metal nitrates, ammonium nitrate, alkali and alkaline earth perchlorates and ammonium perchlorate. The solid component in the primary chamber has a particle size less than 3,000 microns and preferably, about 5–250 microns. The secondary chamber can contain larger particle sizes, in the range of 0.5–10 millimeters, preferably, about 2 millimeters. Microballoons can be present as sensitizing agents in both chambers. The canister containing the particulate oxidizing material is armed by the addition of a liquid hydrocarbon containing bonded nitrogen in a positive valence state which is detonable, but non-cap sensitive. Where two separate chambers, as described previously are involved, a preferred liquid component is about 60–100 percent nitromethane, which, if pure nitromethane is not employed, can be mixed with up to 40 wt. % of higher nitroalkanes having 2 or 3 carbon atoms or various halogenated or nitroaromatic compounds, Where only one chamber is employed in the canister, the charging liquid component would contain at least 75% nitromethane. The explosive charge, when assembled, is detonable by a number 6 blasting cap.

SUMMARY OF THE INVENTION

In accordance with the present invention, there is provided a multi-component explosive composition and its formulation from non-detonable components comprising an unconsolidated particulate aluminum fuel granule mass and a liquid oxidizing material. In carrying out one aspect of the present invention, there is provided a defined body of particulate aluminum fuel. Preferably, the aluminum fuel particles are generally wadded-up aluminum foil granules. The aluminum particles are of considerably larger size than the very fine atomized fuel particles which typically are used in viscous liquid suspensions such as those disclosed in the aforementioned patent to Trapp et al. Thus, in the present invention, the particulate aluminum fuel has an average particle size within the range, of about 1/64–¼ inch and is packed within a canister or other confining structure to provide an average bulk density within the range of 0.2–1.0 gm/cc. In preparing the explosive formulation for use, the aluminum fuel bed is flooded with a liquid oxidizing agent. The oxidizing agent added during the flooding step fills the void space between granules of aluminum, but entraps some voids within the granules to provide an average bulk density of the mixture of oxidizing liquid and particulate aluminum fuel mass within the range of 1.2–1.7 gm/cc, creating an explosive formulation which is detonable in a diameter of 4 inches at 20° C. by a one pound pentolite booster and preferably a ½ pound pentolite booster. Preferably, the explosive formulation is detonable in a diameter in a diameter of 3 inches at 20° C. by a ½ pound pentolite booster. In a preferred embodiment of the invention, the oxidizing liquid comprises an aqueous solution of an oxidizing agent selected from the group consisting of alkali metal and ammonium nitrates, alkali metal and ammonium perchlorates, alkaline earth metal nitrates, alkaline earth metal perchlorates and mixtures thereof. The oxidizing solution may also include a hygroscopic freezing point depressant which may act as a sensitizer in some cases. Preferred freezing point depressants include methanol, ethylene glycol, propylene glycol and glycerol, with ethylene glycol being particularly preferred. Preferred solutes in the aqueous oxidizing solution include ammonium, sodium, potassium, calcium, and magnesium nitrates and ammonium, sodium, and potassium perchlorates and mixtures thereof, with sodium perchlorate (NaP) being particularly desirable.

An alternative oxidizing liquid for use with the particulate aluminum fuel mass comprises nitroethane or a mixture of nitromethane with a higher nitroparaffin selected from the class consisting of nitroethane and nitropropane. A mixture of nitromethane and nitroethane being especially suitable for use in this embodiment of the invention. Preferably, the ratio of nitromethane to nitroethane is within the range of 0.6–1.2 and, more particularly, about 1.0.

The aluminum fuel mass, preferably comprises granules of aluminum foil with an average internal void of 2–30 volume percent. Preferably, the particulate aluminum fuel granules are formed from a thin aluminum foil which has been ground and wadded to form small crumpled granules.

BRIEF DESCRIPTION OF THE DRAWINGS

FIG. 3 is a side elevation, partly in section, illustrating a coupling between two segments of conduit of the type depicted in FIG. 2.

FIG. 4 is a perspective view of yet a modified form of conduit structure useful in implementing the invention; and FIG. 5 is a side elevation, partly in section, of a coupling between two conduit segments of the type depicted in FIG. 4.

DETAILED DESCRIPTION OF THE INVENTION

The multi-component explosive compositions formulated in accordance with the present invention will find use in a wide number of applications, both military and commercial. They may be employed in canisters such as metal bomb, torpedo, or artillery shell casings or in blasting cartridges, typically formulated of metal, plastic or waterproof paper or cardboard or the like. Such canisters typically will range in diameter from a few inches to about a foot (perhaps up to several feet in the case of large bomb or torpedo casings in length about 1 to 5 feet, again, sometimes, somewhat longer in the case of certain bomb casings. They typically will be of relatively rigid structures. In addition to the obvious military applications, such canisters can also be used in blasting operations such as are involved in earth and rock removal or in applications such as seismic prospecting in which relatively small sized cartridges are placed near or on the surface of the ground or lowered down a bore hole and detonated. The formulations of the present invention can also be employed in carrying out blasting operations employing flexible hoses or pipes such as disclosed in the aforementioned U.S. Pat. No. 5,007,973 to Trapp et al. Typically, these applications will involve the use of the aluminum particulate fuel in hose-type configurations which are relatively long. For military applications, those hoses may be buried to provide "tank traps" to impede the advance of armored vehicles. Other operations include the blasting of fire break fines to confine forest fires and in flood control applications such as the blasting of dikes, the blasting of alternative water flow channels, the deepening of channels, the removal of underwater obstructions and similar type operations.

In both military and non-military applications, the oxidizer component of the present invention can be pumped into the aluminum fuel mass component contained in flow channels provided by hoses or pipes which can range in lengths of from about 100 feet up to about 1,000 feet or more. In ditching operations involving the excavation of "tank traps" or flood control channels, the hose or plastic pipe providing the explosive channel typically will vary from about 4–6 inches in diameter and be buried at depths of up to about 4–10 feet. In other applications, the flow channels may be buried to a shallow depth of perhaps one foot or they may be simply laid on the ground. For example, in the blasting of fire break lines, relatively small diameter hose, typically about 2–3 inches in diameter, can be placed in shallow trenches or simply laid on top of the ground.

Figure 1:
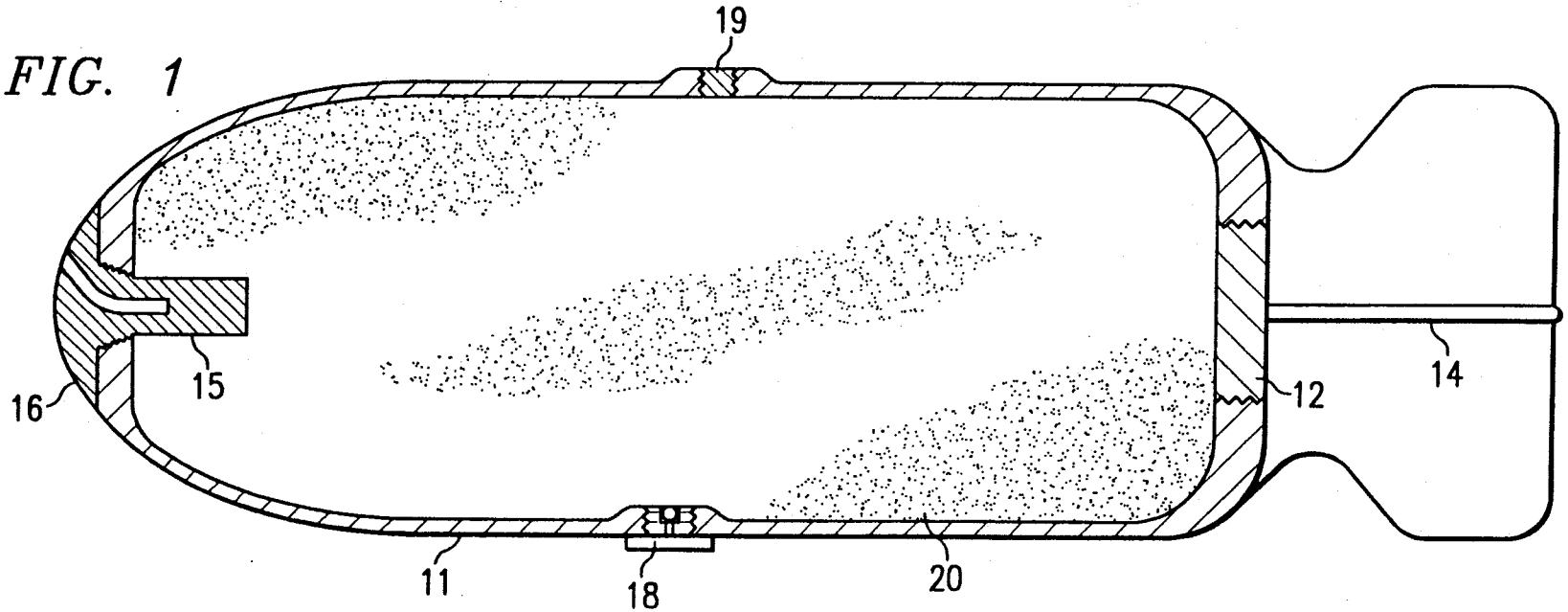
FIG. 1 is a side elevation, partly in section, showing a bomb casing for use in implementing the invention.

Turning now to the drawings, FIG. 1 is a schematic side illustration, partly in section, illustrating a military application of the invention in arming an aerial bomb. It will be recognized in the following discussion that this concept shows outstanding advantages in military applications involving the use of bombs, torpedoes, depth charges and the like, where the use of conventional explosives can present an explosion hazard of catastrophic proportions. As illustrated in FIG. 1, a particulate metal aluminum fuel is confined within a bomb casing 11. The casing typically involves a rear closure member 12 providing access to the interior of the bomb casing. A plurality of tail fins 14 are also provided at the rear of the bomb. The front of the bomb is provided with a booster well 15 in which a suitable booster explosive such as pentolite or the like is located. A nose fuse 16 is provided to cause the booster to detonate upon impact or with other fusing. The bomb is provided with an oxidizing liquid loading port 18 and air vent port 19 at roughly diametrically opposed locations on the bomb casing.

In carrying out the present invention, the bomb is loaded with particulate aluminum fuel 20 through the rear opening and the closure member 12 then secured in place. The granular aluminum fuel is loaded into the bomb to provide an average bulk density of the aluminum within the range of 0.2–1.0 per cubic centimeter; in most applications, the bulk density of the particulate aluminum fuel mass will be within the range of 0.3–0.8 gm/cc. The particulate aluminum fuel mass may also contain microcell material interspersed within the aluminum particles to increase the sensitivity of the final product. Where microcells are used, they should be interspersed throughout the aluminum fuel granules in an amount of up to about 30 volume percent based upon the confined volume of fuel mass. Typically, the microcells will take the form of so-called glass or ceramic microbubbles or microballoons having an average particle size within the range of about 10–400 microns. However, as is well known to those skilled in the art, other cellular materials such as styrofoam beads, polyethylene foam beads or polypropylene foam beads may be utilized. Synthetic resin microballoons formed of resins such as phenol-formaldehyde and natural materials such as perlite may also be used. As will be recognized by those skilled in the art, chemical compatibility with the oxidizer liquid must be maintained.

The particulate aluminum fuel preferably is ground and wadded aluminum foil to provide granules of a relatively high surface area, as described in greater detail below. Other particulate aluminums in a minor proportion may be added such as fine atomized aluminum particles, for example, of about 20 microns, can also be used in combination with foil granules in carrying out the present invention. As indicated previously, the crumpled aluminum foil granules are relatively coarse, ranging in size from about 1/64 to ¼ inch. The atomized aluminum in contrast is much smaller, having an average particle size of 5–100 microns. Where such atomized aluminum is employed, the aluminum foil granules may be treated with a tackifying agent in order to aid in distribution of the atomized aluminum throughout the aluminum fuel body. As described later, a suitable tackifying agent is ethylene, glycol, which may be added to the relative coarse aluminum granules in an amount of about 1 wt. % or less. The aluminum particles may be formed from aluminum metals or alloys which are rich in aluminum as described, for example, in U.S. Pat. No. 3,919,013 to Fox et al., the entire disclosure of which is incorporated herein by reference.

As noted previously, the preferred aluminum fuel particles are manufactured from aluminum foil which is very thin in one dimension such that it will readily react in the detonation. The chopped and wadded granules have a relatively high internal void space and also a relatively high surface area to volume ratio in order to enhance the sensitivity of the ultimate mixture of aluminum and oxidizer liquid. The aluminum foil granules, as described in greater detail below, typically have a surface area to volume ratio of at least 100 centimeters$^{-1}$. The surface area to volume ratio may be much greater, for example, ranging up to 5,000 centimeters$^{-1}$.

The aluminum fuel surfaces, preferably, are only incompletely wettable by the nitrate or perchlorate salt oxidizer liquid. More specifically, the contact angle measured through the liquid phase after the oxidizer liquid is in place is at least 5° to provide an incomplete wetting of the fuel surfaces with the liquid. The aluminum granules or particles may be, and desirably are, coated with a hydrophobic coating in order to render the aluminum surfaces non-wettable with the aqueous oxidizer liquid, i.e., the surfaces are relatively hydrophobic with respect to the aqueous oxidizer solutions described in greater detail below. Suitable coating materials include materials such as those disclosed in U.S. Pat. No. 3,926,698 to Cook et al. as "collectors" which render the aluminum surfaces lipophilic. As disclosed in the Cook et al. patent, the coating materials can include fatty organic acids such as oleic, caprylic acids, tall oils, and various synthetic materials such as alkyl or alkylaryl sulfonates or sulfates. Various silicon containing materials such as organosilanes or siloxanes, which tend to function as water repellent materials, can also be employed as coating materials. A preferred hydrophobic coating material is an organosilane such as the octyltriethoxysilane available from Degussa Corporation under the designation "Silane 208". Others include various oils, waxes, steric acid, oleic acid, palmitic acid, isostearic acid and the organosilane available from Degussa Corporation under the designation "Silane 108". Additional suitable coating materials are disclosed in the aforementioned U.S. Pat. No. 3,926,698 to Cook and also in the aforementioned U.S. Pat. No. 5,007,973 to Trapp et al., the entire disclosures of which are incorporated herein by reference.

The amount of hydrophobic coating material to be employed will vary somewhat, depending upon the nature of the coating material and particulate aluminum fuel; it may vary from 0.1 to 2%. Where the aluminum fuel particles have a high void space which acts as a sensitizer, the use of hydrophobic agent is of less importance, although still desirable. For example, where the aluminum granules are formulated from a thin chopped and wadded aluminum foil, the greater degree of crumpling involved, the more air bubbles are trapped to enhance the sensitivity of the ultimate explosive formulation. In such applications, the amount of hydrophobic coating material can be decreased or dispensed with entirely. When a nitroparaffin is used as the oxidizer liquid, the hydrophobic coatings would not be necessary and normally would not be used.

Returning to FIG. 1 of the drawings, in preparing the bomb for use, the air vent port is opened and the oxidizing liquid is pumped into the loading port at the bottom of the bomb casing. By introducing the oxidizer solution under a positive pressure gradient into the container at or nearest the lowest point, the liquid is allowed to displace air ahead of it as it advances through the particulate fuel mass. The air vent is left open until liquid reaches the point where it starts to flow out of the port. Pumping of oxidizer solution into the bomb casing is then stopped and the loading and vent ports sealed. While the configuration shown in FIG. 1 illustrates a preferred mode of operation, it will be recognized by those skilled in the art, that other loading techniques can be used. For example, the oxidizer liquid can be simply poured into the defined body of particulate fuel. It is preferred, however, that a separate air vent be provided to enable air to escape as the oxidizer liquid advances through the particulate fuel mass, thus favoring complete distribution of oxidizing liquid throughout the aluminum.

Two different types of oxidizing liquids which can be used in carrying out the present invention include aqueous solutions of inorganic nitrate and perchlorate salts and certain nitroparaffin formulations. The latter, while normally functioning as fuels in explosive formulations, can be used in the prevent invention with the aluminum fuel where they function both as fuel and oxidizing agents. The nitrate and perchlorate salts, which usually are preferred, will be described initially. This class of oxidizing agents comprises an aqueous solution of an oxidizing agent selected from the group of the alkali metal and ammonium nitrates and perchlorates and the alkaline earth metal nitrates and perchlorates. Preferably, as described in greater detail below, the aqueous oxidizer solution contains, in addition to water and one or more oxidizing salts, a hygroscopic freezing point depressant for the oxidizer solution.

Conventionally, the oxygen balance of water is considered to be zero since it is ordinarily one of the products of detonation. Using conventional practices, the oxygen balance of the final formulations would be determined to range from zero to 50 percent. In reality, however, water acts as an oxidizer (oxygen balance of +0.89) along with the oxidizer salts for the highly exothermic reaction with aluminum to form aluminum oxide, hydrogen gas and probably methane. If in fact all of the oxygen from the oxidizer salts and water are utilized and free aluminum is still available, the oxygen from the ethylene glycol or other freezing point depressant will be scavenged by the aluminum in the reaction zone to form aluminum oxide rather than water and carbon dioxide. In this case of highly aluminized mixes, some of the ethylene glycol may also be consider& an oxidizer in calculating oxygen balance. Thus, the oxygen balance calculated on the basis of the reaction for these mixes, may range from zero to −20% but preferably, from zero to −12%.

The preferred group of water soluble salts used in formulating the oxidizing liquid consists of ammonium nitrate and perchlorate, sodium nitrate and perchlorate and potassium nitrate and perchlorate from the alkali metal salts and magnesium and calcium nitrate from the alkaline earth metal salts. Of these, aqueous solutions of sodium perchlorate (NaP) will usually be most preferred, followed by aqueous solutions of ammonium nitrate, sodium nitrate and/or calcium nitrate. Various oxidizing salts can be used in mixtures. For example, mixtures of ammonium nitrate with sodium nitrate and calcium nitrate have been found to be effective oxidizing agents in the present invention, but do not possess the low temperature capability nor sensitivity of sodium perchlorate solutions.

As noted previously, the aqueous oxidizing solutions used in the present invention preferably also include minor amounts of one or more hygroscopic freezing point depressants. The use of the freezing point depressant not only extends the climatic conditions under which the invention can be used, but also may enhance the sensitivity of the final formulation. Suitable freezing point depressants for use, in the invention include liquids which are miscible in the oxidizer solution. These may be selected from the group consisting of alcohols, polyhydric alcohols, amides, ethers, and aldehydes containing from 1 to 5 carbon atoms. A more specific group of hygroscopic freezing point depressants for use in the invention include those selected from the class consisting of methanol, formamide, furfural alcohol, glycols, glycol ethers and glycerines. The preferred freezing point depressant is ethylene glycol, as noted previously. However, other readily commercially available materials which can be used in the present invention include methanol, propylene glycol and glycerol. These materials are sometimes used to advantage when mixed with ethylene glycol.

The nitroparaffins which can also be used as the oxidizing liquid to be admixed with the aluminum fuel contain both fuel and oxidizer atoms in their molecular structures. While relatively pure nitromethane can be used as a liquid component with the aluminum fuel noted to provide a highly sensitive material, nitromethane, by itself, is an explosive. Thus, it is preferred to use nitroethane alone or a mixture of nitromethane with a higher nitroparaffin in an amount such that the oxidizer liquid can be stored and handled as a non-explosive. Also, mixtures of nitroethane and nitropropane can be used as the oxidizing liquid, although to less advantage than nitromethane-nitroethane mixtures. In such mixtures, the ratio of nitromethane to nitroethane in the oxidizing liquid preferably is within the range of 0.6–1.2. More preferably, the nitromethane and nitroethane e used in approximately equal amounts to provide a ratio of 1.0. Again, in this embodiment of the invention in which the nitroparaffins supply oxygen for the aluminum, an unconventional method of calculating oxygen balance is involved. More particularly, in this instance, the oxygen balance should be calculated in such a way as to give up all of the available oxygen to the aluminum to form aluminum oxide, methane, hydrogen, and nitrogen as products of detonation. The oxygen balance of nitromethane when it is forced to be an oxidizer, is calculated as 0.52 (gm $O_2$ per grain of NM). For NE, the oxygen balance is 0.43.

As noted previously, it is desirable in formulating the binary explosive mixture in accordance with the present invention to provide complete mixing of the fuel and oxidizer components. To this end, the oxidizing liquid should be of a relatively low viscosity in order to ensure ease of flow of the liquid phase throughout the solid phase. The oxidizing agent liquid can also be, and preferably is, a newtonian fluid since there is no need for suspension of the aluminum particles in a fluid phase, which would indicate the use of a gel or thixotropic liquid. As a practical matter, the viscosity of the oxidizing liquid should be no more than about 100 centipoise at 20° C. The preferred sodium solution has been measured to have a viscosity of 28 centipoise at 20° C., while the nitroparaffins have an average viscosity of about 1 centipoise of 20° C.

The present invention offers significant advantages in both industrial and military applications since nonexplosives can be used to form the final explosive nature just prior to detonation. As a candidate to replace conventional military explosives used in bombs and other heavy ordinance items, the subject invention has numerous advantages. Since no explosive material is manufactured, stored or shipped until immediately prior to use, no danger of premature accidental detonation exists until the liquid component is loaded. The addition of the oxidizer liquid to the aluminum fuel mass is a fast, simple, and safe procedure requiring no dynamic mixing since the liquid simply flows through the solid phase. The two components of the explosive are safe, non-toxic, indefinitely storable, and are widely available and relatively inexpensive. The preferred aqueous oxidizer liquid is, in addition, nonvolatile and, nonflammable. The mixed explosive is operable over a very wide temperature range with little change of sensitivity. With regard to explosive performance, the highly aluminized mixtures of this invention energies much greater than that of TNT, dynamite or ANFO (a dry combination of ammonium nitrate prills and fuel oil). The final explosive formulation need not be, and for most applications preferably is not, cap-sensitive. For most applications of the present invention, satisfactory results can be achieved by providing a final multi-component explosive composition which is detonable at 20° C. in a diameter of 3 inches by a ½ pound pentolite booster. For some applications, detonability in a diameter of 4 inches by a one pound pentolite booster at 20° C. is adequate.

As noted previously, large scale applications, either military or industrial, can be carried out using long horizontal conduits or channels ranging in lengths from tens of feet to thousands of feet which can be buried in either deep or shallow ditches or simply laid out on the ground. The employment of the invention in this type of operation will be described below with respect to military ditching operation such as used in forming "tank traps" and the like. It will be recognized that similar concepts can be applied in industrial or other non-military applications such as in fire fighting. In this application of the invention, the particulate aluminum fuel is loaded into an elongated conduit which can be either flexible or relatively rigid as described below and the pipe then placed at the desired size which, as indicated previously, can be in a ditch up to perhaps ten feet deep or simply laid on the surface of the ground. The aluminum fuel remains in the pipe in the conduit without the addition of the oxidizing liquid until the time for detonation approaches. At this point, the oxidizer liquid is pumped into the conduit where it flows into the interstitial spaces between the aluminum granules.

Various techniques can be employed to place the elongated conduit at the desired location. In one simple and straightforward from of application, the conduit can be in the form of a flexible hose which is filled with the particulate aluminum fuel and wound in a large reel located on a truck. The truck can be driven along the location site and the hoe unreeled and placed on the ground or down into a trench. Alternatively, sections of conduit, which can be formed of plastic or even metallic pipe, can be loaded with the aluminum fuel mass and then placed at the site and fastened together by fluid-tight couplings.

Figure 2:
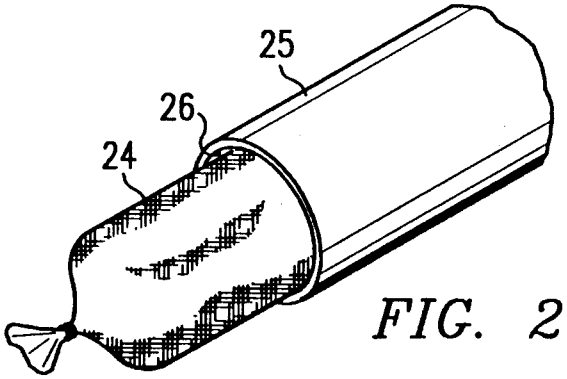
FIG. 2 is a perspective view of a portion of a flexible conduit structure for use in implementing the invention.

Suitable techniques for carrying out the invention using elongated conduits are described below with reference to FIGS. 2 and 4, which are schematic perspective views of elongated conduits exemplifying two different loading techniques. Turning first to FIG. 2, there is illustrated an arrangement suitable for use in ditching applications where an elongated flexible conduit is off-loaded from a reel or the like. As shown in FIG. 2, the particulate aluminum fuel is contained in an internal porous bag 24 which, in turn, is disposed within a semi-rigid continuous hose structure 25 which is formed of an impermeable material such as polypropylene, polyethylene, PVC, rubber, polyurethane or neoprene. The semi-rigid conduit 25 has a greater diameter than the internal porous bag 24 so as to provide an annular space 26 between the two containers. By way of example, the internal porous structure, when packed with the aluminum foil granules, can have an external diameter of 3.75" and fitted within the flexible conduit having an internal diameter of 4.0". The internal bag member 24 can be allowed to simply lie on the bottom of the conduit 25 when it is in the deployed condition. The annulus or partial annulus between the internal bag and the conduit enables the oxidizing fluid to be easily pumped along the entire length of the conduit so that it can soak into the particulate aluminum fuel mass while driving the air ahead. During this operation, the internal conduit or bag structure functions to hold the aluminum particulate mass in place, thus preventing it from being washed along the conduit as oxidizer liquid is pumped into the conduit. The bag material may be a woven plastic, cloth, fiber or other strong but permeable fabrics.

The flexible conduits which are deployed off of a reel can also be used where conduit segments, perhaps several hundred feet in length, are laid out on site and then coupled together. In this arrangement, the internal bag structure should be longitudinally offset relative to the outer conduit so that it protrudes slightly from one end as shown in FIG. 2 and is recessed at the other end. This provides a sequence of male and female interconnections between the flexible conduits as shown in FIG. 3. Thus, when the segments are coupled together, each internal bag structure is placed in an abutting relationship with the subsequent segment as indicated by the abutting relationship between the internal members 24*a* and 24*b*, respectively. This arrangement ensures against discontinuities between successive internal fuel conduits which might cause a failure point in the explosive propagation train. As shown in FIG. 3, the outer conduits 25*a* and 25*b* can be joined together by a coupling collar 28 providing a fluid-tight joint.

Other suitable coupling arrangements which can be used include union connectors where a threaded sleeve joins the two lengths and where positive connection is maintained and disassembly can be quickly accomplished. Other couplers for hose and pipe are sexless, such as those used for hose by fire departments. This design is advantageous in that the couplings at both ends of the hose are exactly the same and orientation of ends is not required. In this case the flexible bag member would protrude the same minimal distance from each end such that some compression would be placed on the internal bag member to maintain a continuous line of aluminum fuel component.

Another embodiment of the invention suitable for use where the explosive mixture is formulated in an elongated conduit or segments thereof, is illustrated in FIG. 4. Here the conduit 30 containing the particulate aluminum fuel mass 31 is provided with an internal relatively small diameter perforated semi-rigid tube 32. When the conduit containing aluminum fuel is in place and ready for detonation, the liquid oxidizing agent is pumped into the perforated tube under a pressure sufficient to force it outwardly throughout the annular aluminum fuel mass. The internal perforated tube 32 can be held in place within the large conduit 30 by means of a spider structure (not shown) which holds the two tubular members in a roughly concentric relationship at each end. Alternatively, the internal tubular member 32 can be held in a roughly concentric relationship by the particulate fuel mass. For example, segments of 10 or 20 or even 30 feet in length can be loaded vertically, with the perforated tube ends centered by a spider piece within the outer conduit tube ends.

For reasons similar to those given above with respect to the arrangement depicted in FIGS. 2 and 3, it is preferred that the couplings between successive joints of the smaller perforated tubular structure be longitudinally offset relative to the couplings between the outer conduit structure. A suitable arrangement for joining pipe segment with such an offset relationship is illustrated in FIG. 5. As shown in FIG. 5, segments 34 and 35 are joined together by offset male-female couplings 37 and 38 for the internal and external conduits respectively. Suitable couplings are provided by externally offset female couplings 37*a* and 38*a* which are adapted to receive male coupling segments 37*b* and 38*b*. The inner coupling 37 need not be sealed tightly since the conduits are perforated and radial flow out of the conduit is desired. As illustrated in FIG. 5, the internal offset coupling receptacle 37*a* is relatively long in comparison with the corresponding coupling offset from the external pipe to accommodate insertion of the smaller diameter conduit first. The female couplings are slightly flared to accommodate quick field connections.

Experimental work carried out with respect to the present invention indicates the results achieved in terms of detonation characteristics with different combinations of granular aluminum fuel and fuel additives with various oxidizing liquids. This work was carried out using particulate aluminum from three sources. One form of granular aluminum is a ground and wadded aluminum foil available from Reynolds Metal Company under the designation "Aluminum Grade HPS-10". This material has an average particle size of about 1/32–⅛ inch, although the granules can be somewhat larger, ranging up to perhaps ¼ inch in the longest dimension of the irregularly shaped granules. The bulk density of this product varies widely from lot to lot, depending on the thickness of the original foil.

Another particulate aluminum fuel is referred to as shredded aluminum foil granules available from Alcan Aluminum Company under the designation "Type F-10". This material normally has a much lower bulk density than the HPS-10 particulate aluminum and in its largest particle dimension is of a slightly greater size than the Reynolds HPS-10 material. A third particle aluminum foil fuel useful in carrying out the present invention is a reclaimed −20 mesh foil identified as "Alumite 2095 Granules", available from U.S. Granules, Plymouth, Ind. This material is made from ground surplus aluminum foil such as gum wrappers and has an average, particle size of about 1/32 to ⅛ inch.

Physical parameters for these particulate aluminum materials are set forth in Table I(A) and I(B). Data for mixes using these various particulate aluminum foil fuels with an oxidizer solution comprising 52.7% sodium perchlorate (NaP) in solution with 34% water (H2O) and 13.3% ethylene glycol (EG) are shown in Table I(A). In Table I(A), the first column shows the bulk density of the dry granular aluminum fuel. The bulk density given is that of the particulate aluminum placed in a container which is then tapped to cause the aluminum to settle under the influence of gravity. The second column shows the density of the mixture of aluminum foil and oxidizer solution and the third column shows the weight percent of aluminum in the fuel-/oxidizing solution mixture. The last column shows the calculated void space for each mixture. A standard screen analysis of the aluminums is shown in Table I(B).

TABLE I(A)

| | Bulk Density (gm/cc) | Mixture Density (gm/cc) | % Al in Mix | Entrapped Void Space (Vol. % of Mix) |
|---|---|---|---|---|
| Reynolds HPS-10 | 0.54 | 1.50 | 36 | 17 |
| Reynolds HPS-10 (Coated with Organosilane) | 0.46 | 1.40 | 33 | 22 |
| Reynolds HPS-10 (Higher Density) | 0.68 | 1.56 | 44 | 19 |
| Alcan Shredded Foil (F-10) | 0.30 | 1.50 | 20 | 11 |
| U.S. Granules, −20 Mesh Foil | 0.47 | 1.59 | 30 | 10 |

TABLE I(B)

| Screen Size | Reynolds HPS-10 Granules (%) | Alcan F-10 Granules (%) | U.S. Granules Grade 2095 (%) |
|---|---|---|---|
| −10 Mesh | 100 | 99.6 | 100 |
| +20 Mesh | 39.5 | 35.6 | 0.2 |
| +30 Mesh | 68.0 | — | 7.8 |
| +50 Mesh | 93.6 | — | 59.3 |
| +60 Mesh | — | 93.6 | — |
| +100 Mesh | 98.9 | 98.6 | 89.0 |
| +140 Mesh | 99.5 | — | — |
| +200 Mesh | -- | 99.8 | 98.6 |
| −200 Mesh | 0.5 | 0.2 | 1.4 |

Table II illustrates the results of oxidizer solution with aluminum foil alone and aluminum foil treated with a small amount of ethylene glycol and containing glass microballoons. The ethylene glycol in the aluminum functions as a tackifying agent to adhere glass bubble to the aluminum particles and provide uniform distribution of the glass bubbles throughout the aluminum matrix. The ethylene glycol acts further to reduce the dust from the small glass bubbles. The glass microballoons used in this test were grade K-1, available from 3-M Co., and having an average particle size of about 100 microns. Each of the aluminum fuel components were mixed with an oxidizer solution containing about 55% sodium perchlorate, 32% water and about 13% ethylene glycol. Table III illustrates certain characteristics and detonation results of the two formulations. As indicated, the formulation containing the ethylene glycol and microballoons in the particulate fuel mixture detonated in a diameter of 1.5 inches using a 100 gram pentolite booster, whereas the first mixture without the microballoons faded in 1.5 inches, but detonated at a diameter of 2 inches with the same booster.

TABLE II

| | No. 1 | No. 2 |
|---|---|---|
| Granular Fuel (% of total) | | |
| HPS-10 Aluminum | 36 | 33.5 |
| EG | — | 0.8 |
| Glass Bubbles, K-1 | — | 1.7 |

TABLE II-continued

| | No. 1 | No. 2 |
|---|---|---|
| Oxidizer Solution | | |
| NaP | 35.6 | 35.6 |
| Water | 20.4 | 20.4 |
| EG | 8.0 | 8.0 |
| Mix Density (gm/cc) | 1.5 | 1.38 |
| Detonation Velocity (Km/sec) | | |
| 2.5 inch dia. PVC Pipe | 3330 | 3310 |
| 2.0 inch dia. PVC Pipe | 3000 | Detonated Not Measured |
| Critical Diameter (inches) | | |
| Smallest Detonating Dia. | 2.0 | 1.5 |
| Largest Failing Dia. | 1.5 | Not Tested |

Table III indicates the results of further experimental work in which various particulate aluminum fuels were disposed in a porous bag which was then inserted into a PVC casing. The sodium perchlorate solution as purchased directly from the manufacturer contained 63.5% sodium perchlorate in 36.5% water, which, when mixed with an amount of 85 parts of this sodium perchlorate solution and 15 parts ethylene glycol resulted in an oxidizer solution containing 54% sodium perchlorate, 31% water and 15% ethylene glycol. The K-1 glass bubbles used in this experimental work also had an average particle size of about 100 microns.

TABLE III

| | No. 1 | No. 2 | No. 3 |
|---|---|---|---|
| Granular Fuel (Parts) | | | |
| HPS-10 Alum. | 40 | 40 | — |
| U.S. Granules 2095 | — | — | 40 |
| Glass Bubbles, K-1 | — | 2 | 2 |
| EG | — | 1 | 1 |
| Oxidizer Solution (100% basis) | | | |
| NaP Sol'n (63.5% NaP, 36.5% $H_2O$) | 85 | 85 | 85 |
| EG | 15 | 15 | 15 |
| Mixture Density (gm/cc) | 1.32 | 1.24 | 1.41 |
| 2.5 inch diameter charge | Detonated | Detonated | Detonated |

Table IV shows the results of experimental work carried out under similar conditions as that depicted in Table III. Here in each test, the aluminum fuel was Reynolds HPS-10 aluminum foil granules mixed with a fine atomized aluminum (nominal particle size of about 20 microns) in relative amounts shown. Here, formulation No. 1, with styrofoam beads microballoons, detonated in 1.5 inch diameter whereas formulation No. 2 with styrofoam beads required a 2 inch diameter charge for detonation. The styrofoam beads of Mix 2 were of a particle density of about 0.1 gm/cc and were about 1/16" diameter. Ethylene glycol was added to the dry mixture of fuels to adhere the smaller particles to the larger and maintain homogeneity. In Mix No. 2, the ethylene glycol was thickened with 0.5% of a Rhamsam gum type K1A112 available from Kelco Co., Chicago, Ill. to aid in distribution of the styrofoam beads.

TABLE IV

| | No. 1 | No. 2 |
|---|---|---|
| Granular Fuel | | |
| HPS-10 Aluminum | 30 | 30 |
| Fine Atomized Aluminum | 12 | 12 |
| Glass Bubbles, K-1 | 3 | — |
| Fine Styrofoam Beads | — | 1 |
| EG | 1 | 2 (thickened) |
| Granular Fuel Density (gm/cc) | 0.65 | 0.65 |

TABLE IV-continued

| | No. 1 | No. 2 |
|---|---|---|
| Oxidizer Solution (parts) | | |
| NaP Sol'n (56% NaP) | 48 | 48 |
| EG | 7 | 7 |
| 2.0 inch diameter | — | Detonated |
| 1.5 inch diameter | Detonated | Failed |

Table V shows the results of experimental work carried out using Alcan shredded foil F-10 granules mixed with oxidizer solutions containing sodium perchlorate in water as a solvent or in aqueous solutions of ethylene glycol, methanol, or N-methylpyrrolidone as shown. As indicated, the formulation containing ethylene glycol detonated in charge diameters down to 1½ inch. Mix No. 2 with no freezing point depressant, detonated in a charge diameter of 3 inches, whereas Mixes 3 and 4 containing methanol and n-methylpyrrolidone, respectively, failed in 3 inch diameter but detonated in 4 inch diameter.

TABLE V

| | No. 1 | No. 2 | No. 3 | No. 4 |
|---|---|---|---|---|
| Granular Fuel (%) | | | | |
| Alcan Foil Aluminum Granules (Bulk Density of 0.30 gm/cc) | 20 | 19.2 | 17.9 | 16.7 |
| Oxidizer Solution (%) | | | | |
| NaP Solution (60.8% NaP 39.2% $H_2O$) | 68 | 80.8 | 73.9 | 75.0 |
| EG | 12 | — | — | — |
| Methanol | — | — | 8.2 | — |
| N-methylpyrrolidone | — | — | — | 8.3 |
| Mix Density (gm/cc) | 1.50 | 1.50 | 1.52 | 1.60 |
| Detonation Velocity (Km/sec) | | | | |
| 4.0 inch dia. | — | — | Detonated | 2.76 |
| 3.0 inch dia. | — | 2.82 | Failed | Failed |
| 2.0 inch dia. | 3.13 | Failed | Failed | Failed |
| 1.5 inch dia. | 2.82 | — | — | — |
| 1.25 inch dia. | 2.52 | — | — | — |
| 1.0 inch dia. | Failed | — | — | — |

Table VI shows the results of using an oxidizer solution comprising ammonium nitrate and Norsk Hydro calcium nitrate in a methanol mixture. The Norsk Hydro calcium nitrate prills contain approximately 79% calcium nitrate, 6% ammonium nitrate and 15% water of hydration. As is evident from a comparison of the results in Table VI with the work discussed earlier, the calcium nitrate, nitrate solution, while effective, did not provide as good results as the sodium perchlorate solutions.

TABLE VI

| Composition % | No. 1 |
|---|---|
| Dry Component (%) | |
| HPS-10 Aluminum | 31.9 |
| Styrofoam Beads | 1.1 |
| Liquid Component (%) | |
| AN | 6.7 |
| Norsk Hydro CN | 40.2 |
| Methanol | 20.1 |
| Density of Mixture (gm/cc) | 1.25 |
| Detonation Results | 3" dia. det. |
| (Det. Vel.) | 3.18 Km/sec. |

Table VII shows the results of two explosive mixtures based upon Reynolds Metal HPS-10 aluminum foil. In Mix No. 1, the aluminum foil, as received, was used. In Mix No. 2, the foil was coated with 0.5% of the organosilane previously identified as Silane 208. The Norsk Hydro calcium nitrate was the same as that described previously with reference to the work reported in Table VI. Mix No. 1 was detonated immediately after adding the oxidizer solution to the aluminum fuel mass and Mix No. 2 was allowed to stand about 2 days before detonating. As indicated, both detonated in charge diameters of 3 inches producing similar results.

TABLE VII

| | No. 1 | No. 2 |
|---|---|---|
| Granular Fuel (%) | | |
| HPS-10 | 32 | — |
| HPS-10, Coated With Silane 208 | — | 31.6 |
| Liquid Oxidizer (%) | | |
| Ammonium Nitrate | 20.4 | 20.5 |
| Norsk Hydro Calcium Nitrate | 32.0 | 30.8 |
| Water | 8.8 | 10.3 |
| EG | 6.8 | 6.8 |
| Density (gm/cc) | 1.48 | 1.51 |
| Detonation Velocity in 3 inch dia. (Km/sec.) | 3.25 | 3.13 |

As noted earlier an alternative to the use of the inorganic salts in the oxidizer solution involves the use of a nitroparaffin liquid. Nitromethane alone is highly explosive; however, nitromethane can be mixed with a higher molecular weight nitroparaffin in order to produce a non-explosive mixture. Table VIII indicates the detonability of various mixtures of nitromethane and nitroethane as shown by progressively increasing the weight percent of nitroethane. The detonability of the mixture is substantially curtailed with increasing amounts of nitroethane.

TABLE VIII

| Composition (%) | No. 1 | No. 2 | No. 3 | No. 4 |
|---|---|---|---|---|
| NM | 100 | 75 | 60 | 55 |
| NE | 0 | 25 | 40 | 45 |
| Critical Diameter* | 1¼ | 2½ | 6.0 | >6.0 |

*Minimum diameter in inches for sustained detonation using Pentolite Boosters

Table IX shows the results of tests carried out using a very dense lot of Reynolds aluminum product HPS-10 in admixture with nitromethane alone, nitroethane alone, and equal parts of nitromethane and nitroethane. The aluminum foil granules in this test had a very high bulk density of 0.79 gm/cc. As shown in Table IX, the oxidizer solution containing equal parts of 2 inches, as did the pure nitromethane oxidizing liquid. Mix 2 with pure nitroethane detonated in 2½ inches and failed in 2 inches.

TABLE IX

| Composition (%) | Mix No. 1 | Mix No. 2 | Mix No. 3 |
|---|---|---|---|
| Special High Density HPS-10 Alum at a bulk density of 0.79 gm/cc | 50 | 52 | 51 |
| Nitromethane | 50 | 0 | 24.5 |
| Nitroethane | 0 | 48 | 24.5 |
| Density of Mix (gm/cc) | 1.58 | 1.52 | 1.55 |
| Test Results: | | | |
| 1.5 inch dia | — | — | Failed |
| 2.0 inch dia | Detonated | Failed | Detonated |
| 2.5 inch dia | — | Detonated | — |

Tables X and XI show additional results of explosive mixtures achieved using nitroparaffins and particulate aluminum fuel. In Table X, the fuel was Alcan Aluminum foil granules having a bulk density of 0.3 gm/cc. In Table XI, the aluminum fuel was HPS-10 packed to a bulk density of 0.47 gm/cc. In each of the Tables, Mix No. 1 was carried out with pure nitroethane as the oxidizer liquid. In Mix No. 2 of each Table, the oxidizer liquid was comprised of a 50/50 mixture of nitroethane and nitroethane. In both Tables, the nitromethane-nitroethane mixture detonated in a diameter of 2 inches, whereas the pure nitroethane required a diameter of 3 inches for detonation.

Another detonation test was made at low temperature using HPS-10 aluminum at a bulk density of 0.66 gm/cc and pouring in a 50/50 blend of nitroethane and nitromethane flooding the aluminum fuel completely. A 2½ inch diameter PVC pipe 24" long containing the mixture detonated at −23° C. using a one pound pentolite booster.

TABLE X

| Composition (%) | No. 1 | No. 2 |
|---|---|---|
| Alcan Aluminum Foil Granules (%) (Bulk Density of 0.30 gm/cc) | 21.2 | 20.8 |
| Nitroethane | 78.8 | — |
| NE/NM (50/50) | — | 79.2 |
| Density of Mixture (gm/cc) | 1.18 | 1.20 |
| Test Results in SCH 40 PVC Pipe @ 20° C. (Detonation Velocity in Km/sec.) | | |
| 3" dia. × 24" | 4.55 | — |
| 2.5" dia. × 20" | Failed | — |
| 2" dia. × 20" | Failed | 4.82 |

TABLE XI

| Composition (%) | No. 1 | No. 2 |
|---|---|---|
| HPS-10 Aluminum Granules (%) (Bulk Density of 0.47 gm/cc) | 35.5 | 35.0 |
| Nitroethane | 64.5 | — |
| NE/NM (50/50) | — | 65.0 |
| Density of Mixture (gm/cc) | 1.31 | 1.33 |
| Test Results in SCH 40 PVC Pipe @ 20° C. (Detonation Velocity in Km/sec.) | | |
| 3" dia. × 24" | 44.4 | — |
| 2.5" dia. × 20" | Failed | — |
| 2" dia. × 20" | Failed | 5.06 |

The amount of entrapped air void space remaining within the aluminum mass after the addition of the oxidizer liquid is a strong function of the type of oxidizing solution which is added. The nitroparaffins are very low in viscosity and tend to wet the aluminum surface completely and dissolve any hydrophobic coatings which may be present. On the other hand, the aqueous oxidizer salt solutions trap a considerable amount of air within the aluminum fuel granule matrix. Any oil films or hydrophobic coatings on the aluminum surface aid in entrapping air voids both within the aluminum granule and around it. Table XII shows the amount of entrapped air which results when a container filled with an identical HPS-10 aluminum is flooded with nitromethane, nitroethane and a sodium perchlorate/ethylene glycol solution. This solution was formed with 54% sodium perchlorate, 31% water, and 15% ethylene glycol to provide a density of 1.53 gm/cc.

TABLE XII

| | Mix No. 1 | Mix No. 2 | Mix No. 3 |
|---|---|---|---|
| HPS-10, weight % Bulk density = 0.60 gm/cc | 37 | 44 | 41 |
| NaP Solution, weight % | 63 | — | — |
| NE, weight % | — | 56 | — |
| NM weight % | — | — | 59 |
| Mixture Density (gm/cc) | 1.63 | 1.36 | 1.45 |

TABLE XII-continued

| | Mix No. 1 | Mix No. 2 | Mix No. 3 |
|---|---|---|---|
| Void-Free Density | 1.83 | 1.43 | 1.48 |
| Entrapped Gas Volume % of Mix | 11 | 5 | 3 |

As can be seen by an examination of the data in Table XII, when the aluminum mass is flooded with the aqueous sodium perchlorate solution, substantially more air is entrapped than occurs with flooding with nitroethane or nitromethane.

Having described specific embodiments of the present invention, it will be understood that modifications thereof may be suggested to those skilled in the art, and it is intended to cover all such modifications as fall within the scope of the appended claims.

What is claimed is:

1. In a method for formulating a multi-component explosive composition, the steps comprising:
   (a) providing a defined body of unconsolidated particulate aluminum fuel granules having an average particle size within the range of 1/64–¼ inch and an average bulk density within the range of 0.2–1.0 gm/cc;
   (b) providing a phase oxidizing liquid; and
   (c) flooding said body of particulate aluminum fuel of step (a) with the oxidizing liquid of step (b) to provide a bulk density of said mixture of oxidizing liquid and particulate aluminum fuel mass within the range of 1.2–1.7 gm/cc and provide an explosive formulation detonable at 20° C. in a diameter of 4 inches by a one pound pentolite booster.

2. The method of claim 1, wherein said explosive formulation is detonable at 20° C. in a diameter of 3 inches by a ½ pound pentolite booster.

3. The method of claim 1, wherein said aluminum fuel granules are formed from chopped and wadded aluminum foil.

4. The method of claim 3 wherein said aluminum fuel particles have an average internal porosity within the range of 2–30 volume percent.

5. The method of claim 3, wherein said particulate aluminum fuel has an average surface area to volume ratio of at least 100 $cm^{-1}$.

6. The method of claim 1, wherein said body of aluminum fuel comprises a minor portion of atomized aluminum.

7. The method of claim 6, wherein said atomized aluminum has an average particle size within the range of 5–100 microns.

8. The method of claim 6, wherein said aluminum fuel body contains a liquid tackifying agent to promote distribution of said atomized aluminum throughout said aluminum fuel body.

9. The method of claim 1, wherein said particulate aluminum has a bulk density within the range of 0.3–1.0 gm/cc.

10. The method of claim 1, wherein said oxidizing liquid comprises a nitroparaffin selected from the group consisting of nitromethane, nitroethane, nitropropane and mixtures thereof.

11. The method of claim 10, wherein said oxidizing liquid comprises nitroethane.

12. The method of claim 1, wherein said oxidizing liquid comprises a mixture of nitromethane with a higher nitroparaffin selected from the group consisting of nitroethane and nitropropane.

13. The method of claim 12, wherein said oxidizing liquid comprises a mixture of nitromethane and nitroethane.

14. The method of claim 13, wherein the ratio of nitromethane to nitroethane in said oxidizing liquid is within the range of 0.6–1.2.

15. The method of claim 14, wherein the ratio of nitromethane to nitroethane is about 1.0.

16. The method of claim 1, wherein said oxidizing liquid component is a newtonian fluid.

17. The method of claim 1, wherein said oxidizing liquid component has a viscosity of no more than 100 cp at 20° C.

18. The method of claim 1, wherein said defined body of particulate aluminum fuel contains microbubbles interspersed with the said aluminum fuel particles.

19. The method of claim 18, wherein said aluminum fuel body contains a liquid tackifying agent to promote distribution of said microbubbles throughout said aluminum fuel body.

20. The method of claim 1, wherein said defined body of particulate aluminum is confined within an enclosed container which is vented to allow air to escape from said container as said oxidizing liquid is introduced into said container.

21. The method of claim 1, wherein said oxidizing liquid comprises an aqueous solution of an oxidizing agent selected from the group consisting of alkali metal and ammonium nitrates, alkali metal and ammonium perchlorates, alkaline earth metal nitrates, alkaline earth metal perchlorates and mixtures thereof.

22. The method of claim 21, wherein said aluminum particles are coated with a hydrophobic coating material.

23. The method of claim 22, wherein said hydrophobic coating material is an organosilane.

24. The method of claim 21, wherein the contact angle of said oxidizing liquid with respect to said particulate aluminum fuel is at least 5° to provide substantial incomplete wetting of said aluminum fuel surfaces with said oxidizer liquid.

25. The method of claim 21, wherein said aqueous solution comprises a hygroscopic freezing point depressant.

26. The method of claim 25, wherein said hygroscopic freezing point depressant is a sensitizer which functions to increase the sensitivity of said explosive composition.

27. The method of claim 25, wherein said hygroscopic freezing point depressant is selected from the group consisting of alcohols, polyhydric alcohols, amides, ethers, and aldehydes containing from 1–5 carbon atoms.

28. The method of claim 25, wherein said hygroscopic freezing point depressant is selected from the group consisting of methanol, formamide, furfural, furfural alcohol, glycols, glycol ethers and glycerins.

29. The method of claim 25, wherein said freezing point depressant is selected from the group consisting of methanol, ethylene glycol, propylene glycol, and glycerol.

30. The method of claim 25, wherein said freezing point depressant is ethylene glycol.

31. The method of claim 1, wherein said oxidizing liquid comprises an aqueous solution selected from the group consisting of ammonium nitrate, sodium nitrate, potassium nitrate, calcium nitrate, magnesium nitrate, ammonium perchlorate, sodium perchlorate, potassium perchlorate, and mixtures thereof.

32. The method of claim 1, wherein said oxidizing liquid comprises an aqueous sodium perchlorate solution.

33. The method of claim 32, wherein said aqueous solution includes a hygroscopic freezing point depressant selected from the group consisting of methanol, ethylene glycol, propylene glycol and glycerol.

34. The method of claim 33, wherein said freezing point depressant is ethylene glycol.

35. The method of claim 34, wherein said aluminum fuel particles have an average internal porosity within the range of 2–30 percent.

36. The method of claim 35, wherein said aluminum particles are coated with a hydrophobic coating material.

37. The method of claim 36, wherein said hydrophobic coating material is an organosilane.

38. In a method for formulating a multi-component explosive composition, the steps comprising:

(a) providing a defined body of unconsolidated aluminum fuel particles having an average internal porosity of at least 2 volume percent;

(b) providing an aqueous oxidizing solution of an oxidizing agent selected from the group consisting of alkali metal and ammonium nitrates, alkali metal and ammonium perchlorates, alkaline earth metal nitrates, alkaline earth metal perchlorates and mixtures thereof in an aqueous solution comprising a mixture of water and a hygroscopic freezing point depressant for water; and (c) flooding said body of aluminum fuel particles of step (a) with the oxidizing solution of step (b) to provide a bulk density of said mixture of oxidizing solution and particulate aluminum fuel mass within the range of 1.2–1.7 gm/cc to provide an explosive formulation detonable at 20° C. in a diameter of 4 inches by a one pound pentolite booster.

39. The method of claim 38, wherein said oxidizing agent is selected from the group consisting of ammonium nitrate, sodium nitrate potassium nitrate, calcium nitrate, magnesium nitrate, ammonium perchlorate, sodium perchlorate, potassium perchlorate, and mixtures thereof.

40. The method of claim 39, wherein said aqueous agent comprises sodium perchlorate present in a predominant amount.

41. The method of claim 40, wherein said freezing point depressant is selected from the group consisting of methanol, ethylene glycol, propylene glycol, and glycerol.

42. The method of claim 41, wherein said freezing point depressant is ethylene glycol.

43. The method of claim 42, wherein said aluminum fuel particles are formed from aluminum foil.

44. The method of claim 38, wherein said defined body of aluminum fuel contains microcells interspersed with said aluminum fuel particles.

45. The method of claim 38, wherein said aluminum fuel particles are provided with a hydrophobic coating material.

46. The method of claim 45, wherein the contact angle of said oxidizing liquid with respect to the surfaces of said aluminum fuel particles is at least 5° to provide incomplete wetting of said metal fuel surfaces with said oxidizer liquid.

47. The method of claim 38, wherein said particulate aluminum fuel has an average surface area to volume ratio of at least 100 $cm^{-1}$.

48. The method of claim 38, wherein said liquid fuel component has a viscosity of no more than 100 cp at 20° C.

* * * * *